United States Patent [19]

Herrera-Casasus

[11] 4,023,768

[45] May 17, 1977

[54] ICE CUBE MOLD

[76] Inventor: Crisogono Herrera-Casasus, Escobedo Sur 733 Suite 201, Monterrey, Nuevo Leon, Mexico

[22] Filed: Feb. 24, 1975

[21] Appl. No.: 552,057

[52] U.S. Cl. ..... 249/81; 249/120; 249/127; 249/132

[51] Int. Cl.[2] ..... F25C 1/04

[58] Field of Search ..... 249/127, 66, 69, 120, 249/121, 81, 79, 80, 70–72, 129, 130, 132, 203

[56] References Cited

UNITED STATES PATENTS

| | | | |
|---|---|---|---|
| 2,003,432 | 6/1935 | Finch | 249/79 |
| 2,166,560 | 7/1939 | Schmelzer | 249/66 |
| 2,386,979 | 10/1945 | Rundell | 249/71 |
| 2,574,662 | 11/1951 | Sampson | 249/71 |
| 3,829,056 | 8/1974 | Baker et al. | 249/69 |

*Primary Examiner*—Francis S. Husar
*Assistant Examiner*—John McQuade
*Attorney, Agent, or Firm*—Laurence R. Brown

[57] ABSTRACT

The present invention refers to improvements to receptacles for making ice cubes which make it possible to dislodge the ice cubes from the tray in an easy and simple manner once they have been taken from the freezer. Such is accomplished by means of a water chamber between the multiple mold and the tray which holds it, which upon being filled distributes water all around the ice cubes, dislodging them immediately. The tray also serves as a container once the cubes have been dislodged. To dislodge cubes it is unnecessary to hit the mold, submerge it in water or twist it.

5 Claims, 4 Drawing Figures

ICE CUBE MOLD

Figure 1:
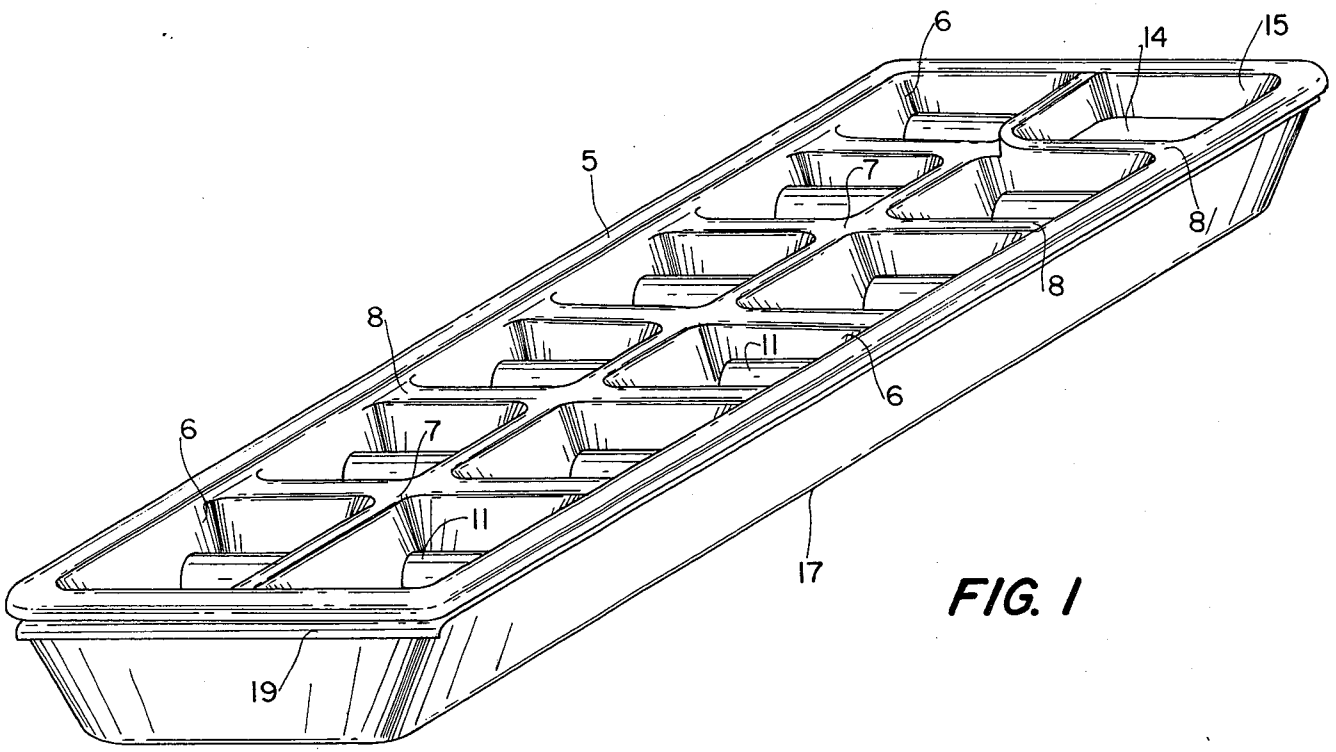
Figure 2:
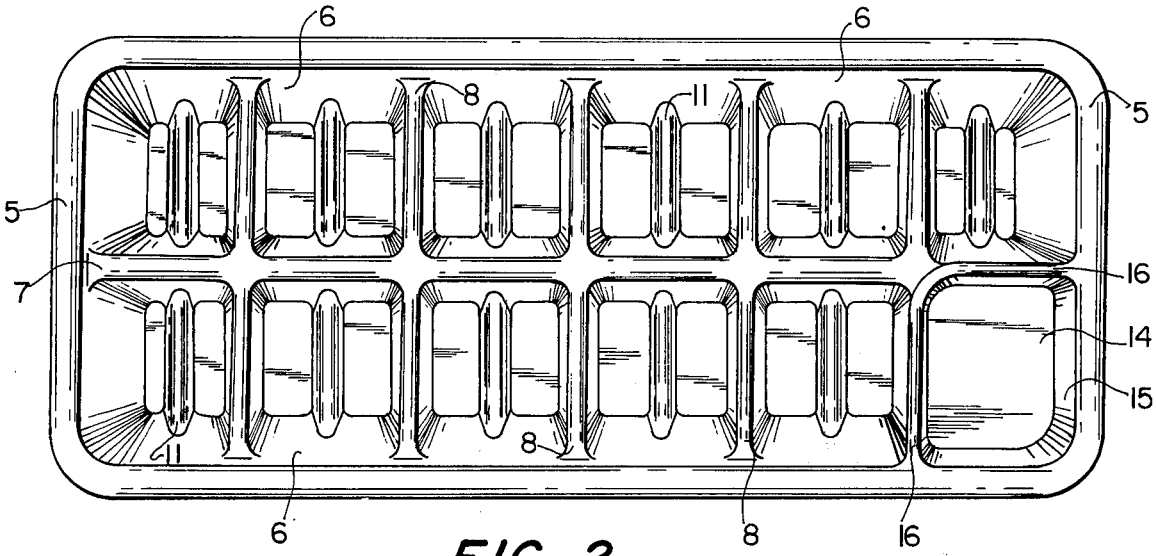
Figure 3:
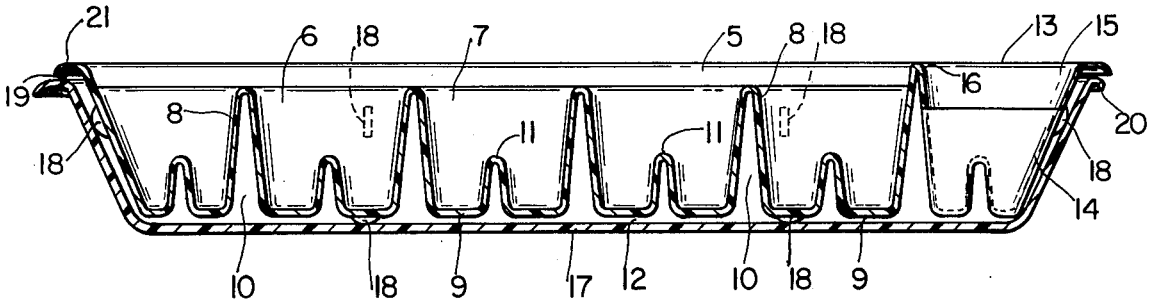
Figure 4:
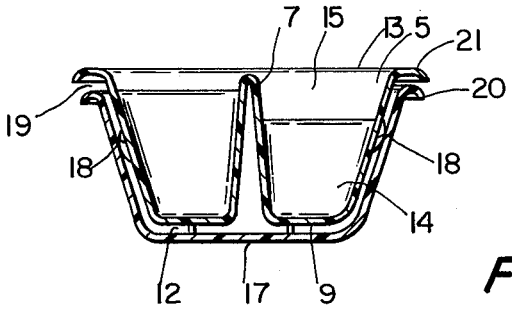

The present invention refers to improvements to receptacles for making ice cubes which it is possible to dislodge the ice cubes from the tray in an easy and simple manner after they have been taken from the freezer. A water chamber between the multiple mold and the tray which holds it, is filled to distribute water all around the ice cubes, dislodging them immediately. Also the tray serves as a container so that once the cubes have been dislodged they may be placed in it. In order to dislodge cubes it is unnecessary to hit the mold, submerge it in water or twist it.

The purpose of the present invention is to avoid the disadvantages of prior art operations by means of the receptacle herein described and to simply and easily allow the complete dislodging of all the ice cubes, in a tray which is also more compact, durable and functional.

The characteristic details of the present invention are clearly shown in the following description and in the accompanying drawings and the same reference symbols serve to show the same parts in the different figures.

FIG. No. 1 shows a perspective top view of the receptacle.

FIG. No. 2 is a plan view of the receptacle.

FIG. No. 3 is a cross sectioned side view of the receptacle showing the water chamber.

FIG. No. 4 is a cross section end view of the receptacle.

With reference to said figures, this receptacle is made up of a multiple mold 5 manufactured of plastic or metal material, or of any other appropriate material as well with some deposit areas or receptacles 6 over which the liquid is poured so that once it is submitted to the freezing process, the formation of an ice cube is produced in each one of these areas 6. These areas of deposite 6 are formed by longitudinal dividers 7 and a series of crosswise dividers 8 formed on the bottom panel 9 of the mold, which are pyramidal in shape, that is to say, that they are wider at the lower part than at the upper part. The height of these dividers 7 and 8 is below the height of the perimetral ring 21 of the mold 5 in such a manner that the liquid trickles into the receptacles 6. The advantage produced by the formation of the dividers 7 and 8 on the bottom panel 9 is that it forms a series of spaces 10 which allow water to reach all around the walls which form the receptacles 6. In the center part of these deposit receptacles 6 are channels 11 also formed as the dividers 7 and 8 but shorter, allowing the tray to have a greater surface area for rapid freezing and melting.

At one end 13 of the mold 5 at the place which would commonly be occupied by one of the receptacles, an opening 14 is formed through which the water chamber 12 is filled to dislodge the cubes. Thus there is no need to twist or bang the mold but rather simply, water is to be poured into the opening 14 so that it is distributed throughout the chamber all around the cubes, dislodging them immediately. This opening 14 has a ridge about its perimeter 16 at the same level as the perimetral ring 21 which keeps the water from spilling towards the cubes. It also has a lip 15 which funnels water towards the inside of the water chamber 12.

The water chamber 12 is formed by a space between the tray 17 and the outside walls of the mold 5. When this chamber 12 is filled through the opening 14 of the mold 5, water is distributed around the cubes melting them and thereby making it possible for them to dislodge from the mold 5 immediately. To speed the thawing of the cubes, the chamber 12 has an opening 19 all around the receptacle 6, in such a manner that the water flows through the periphery of the tray 17 allowing a constant flow which would make is possible for the cubes to dislodge rapidly.

The tray 17 is shaped in such a way that it fits in the lower part of the multiple mold 5 leaving a space which makes up the water chamber 12. So that such a space is formed, the mold 5 has some dividers 18 which keep the mold 5 and the tray 17 from joining. Also the tray 17 may be used as a container to place the cubes to be used as desired.

The manner in which the tray functions is the following: Once the receptacle with ice cubes is taken from the freezer, water is poured through the opening 14 which is at the extreme end of the tray, until the chamber is completely filled 12 and carries water all around the cubes. Once the chamber is filled, water should continue to be poured into it so that it circulates inside the chamber at the same time it is spilling out around the periphery of the tray thus speeding up the melting of the cubes. When the cubes are dislodged, the receptacle is tilted in order to pour out the water completely.

I claim:

1. Ice cube making and release means comprising in combination, a longitudinal outer tray member, a mating inner tray member having indentations defining a set of receptacles for forming ice cubes, means positioning said inner tray member within said outer tray member and forming therewith a chamber between said two tray members along the length thereof, and means comprising an inlet opening defined through said inner tray member at one end thereof into said chamber and an outlet opening from said chamber at the opposite end thereof thereby forming a continuous water flow path through said chamber in contact with said receptacles to thereby permit release of cubes frozen in said receptacles by means of water flow through said path.

2. Means as defined in claim 1 wherein said two tray members are separable so that said outer tray member can receive released cubes from said inner tray member.

3. Means as defined in claim 1 wherein said set of receptacles are formed in two parallel rows, and side-by-side means at one end of said two rows defining one receptacle and said inlet opening.

4. Means as defined in claim 1 wherein the two tray members are spaced apart and have flow channels defined in said inner tray member to flow water through said inlet opening and in contact with substantially the entire receptacle body of each receptacle in said set.

5. Means as defined in claim 1 wherein said two tray members have upper rims spaced apart to form said outlet opening between the upper rims thereof.

* * * * *